US006311603B1

(12) United States Patent
Dunlap

(10) Patent No.: US 6,311,603 B1
(45) Date of Patent: Nov. 6, 2001

(54) FIREARM CHARGING HANDLE

(76) Inventor: Norman D. Dunlap, 03663 Forrest La., New Breman, OH (US) 45889

( * ) Notice: Subject to any disclaimer, the term of this patent is extended or adjusted under 35 U.S.C. 154(b) by 0 days.

(21) Appl. No.: 09/418,485

(22) Filed: Oct. 15, 1999

(51) Int. Cl.[7] ..... B64D 1/04

(52) U.S. Cl. ..... 89/1.4; 89/191.01; 89/192; 42/2

(58) Field of Search ..... 89/179, 191.01, 89/191.02, 192, 1.4, 1.1; 42/2

(56) References Cited

U.S. PATENT DOCUMENTS 3,225,653 * 12/1965 Packard ..... 89/1.4
4,827,652 * 5/1989 Martin ..... 89/1.4
5,272,956 * 12/1993 Hudson ..... 89/128
5,551,179 * 9/1996 Young ..... 42/16

* cited by examiner

*Primary Examiner*—J. Woodrow Eldred
(74) *Attorney, Agent, or Firm*—Michael W. York

(57) ABSTRACT

A charging handle for a firearm having a receiver, a bolt and bolt carrier reciprocating within the receiver and a gas tube for directing powder gases to cause operation of the bolt carrier and bolt within the receiver. The charging handle is a generally elongated member having a forward end portion and a rearward end portion with the rearward portion having a portion that extends outside of the receiver that is sized, shaped and adapted to be grasped by a hand of a shooter using the firearm. The charging handle has grooves and gas deflecting surfaces for diverting and deflecting powder gases to protect the shooter from powder gases that may develop around the charging handle when the firearm is fired.

11 Claims, 3 Drawing Sheets

FIREARM CHARGING HANDLE

BACKGROUND OF THE INVENTION

When a cartridge is fired in a firearm the powder in the cartridge is ignited by the primer and as the powder burns it generates gases that propel the bullet out of the cartridge case and down the barrel of the firearm. Normally, most of these gases leave the bore of the barrel of the firearm after the bullet exits the bore since the rear of the barrel is sealed during the firing process by the cartridge case which expands outward under the pressure of the gases to seal the chamber area of the barrel.

With certain firearms a portion of the gases in the bore of the barrel are used to open the action of the firearm. In such cases there is usually a port or hole along the barrel that permits a portion of the gases to be directed outside of the bore of the barrel. These gases either impinge upon a part, usually called an operating rod, that serves to unlock the breech of the firearm or are fed via what is usually called a gas tube to what is called a bolt carrier where the gases exert a rearward force upon the bolt carrier that results in unlocking the bolt and causing it to move to its open rearward position. In the M-16 or M-15 family of firearms, the bolt carrier also has a part called the bolt carrier key for receiving the gases from the gas tube. In this latter type of operation this results in gases in and around the bolt carrier in the receiver that need to be dispersed.

In the well known M-16 or AR-15 family of firearms, two holes are provided in the bolt carrier that are designed to vent gases within the bolt carrier outward and away from the receiver area of the firearm. However, these holes in practice do not vent all of the gases outside of the receiver and in addition a certain amount of gases are dumped into the receiver of the firearm when the bolt carrier key with its gas hole moves rearward away from the rear portion of the gas tube when the bolt carrier is pushed to the rear under gas pressure. This gas tends to travel to the rear of the receiver along the paths created by the charging handle and its associated pathway in the receiver. Since the rear portion of the charging handle is located near the eyes of the shooter this has the undesirable and dangerous effect of diverting gases into shooter's eyes which can cause eye damage or at least interfere with the shooter's ability to see properly and hence shoot accurately.

As might be expected, this undesirable and potentially dangerous gas situation becomes even more severe with a firearm that is fired fully automatically. It has also been determined that the dangerous gas situation is severe in suppressed firearms.

In the past there have been various attempts to remedy or alleviate this undesirable and dangerous problem. These have included the use of silicone rubber seals and the addition of baffles. Unfortunately, gas and heat resulted in the eroding away of the silicone rubber seals and baffles have a tendency to fall off the receiver of the firearm.

This invention eliminates the undesirable and dangerous problem of gas near the eyes of the shooter. With this invention, the gas in the vicinity of the firearm charging handle is controlled and is diverted away from the eye region of the shooter. This is also accomplished without any modifications to the basic firearm by a simple substitution of a new charging handle that is fully compatible with the existing firearm receiver and other associated parts. With this new charging handle the gas is both diverted and the eyes of the shooter are also shielded. In addition, the new charging handle also has provisions for making it easier to be operated by the shooter.

SUMMARY OF THE INVENTION

This invention relates to firearm charging handles for loading a firearm with a cartridge and more particularly to firearm charging handles that protect the shooter and are easier to operate.

Accordingly, it is an object of the invention to provide a firearm charging handle that has increased safety for the shooter.

It is an object of the invention to provide a firearm charging handle that protects the eyes of the shooter.

It is an object of the invention to provide a firearm charging handle that controls gases that develop within the receiver of a firearm when it is fired.

It is an object of the invention to provide a firearm charging handle that is particularly useful with firearms that fire semi-automatically and or fully automatically.

It is an object of the invention to provide a firearm charging handle that is particularly useful with firearms that fire semi-automatically and or fully automatically such as the AR-15 or M-16 type firearms.

It is an object of the invention to provide a firearm charging handle that is particularly useful with firearms that fire semi-automatically and or fully automatically that are sound suppressed.

It is an object of the invention to provide a firearm charging handle that avoids sighting problems related to powder gases in the shooter's eyes.

It is an object of the invention to provide a firearm charging handle that diverts powder gases away from the shooter's eyes.

It is an object of the invention to provide a firearm charging handle that shields the eyes of the shooter from undesired and dangerous powder gases.

It is an object of the invention to provide a firearm charging handle that is easier to operate than current charging handles.

It is an object of the invention to provide a firearm charging handle that is easily operated by the shooter while wearing gloves.

It is an object of the invention to provide a firearm charging handle that has an improved latch.

It is an object of the invention to provide a firearm charging handle that has an improved latch that is more comfortable for the shooter to operate than the current latch.

It is an object of the invention to provide a firearm charging handle that is readily interchangeable with existing AR-15 or M-16 type firearms family charging handles.

It is an object of the invention to provide a firearm charging handle that requires no modification of the firearm for its use.

These and other objects will be apparent from the charging handle invention for a firearm having a receiver, a bolt reciprocating within the receiver and a gas tube for directing powder gases to cause operation of the bolt within the receiver in which the charging handle includes a generally elongated member having a forward end portion and a rearward end portion, with the rearward portion having at least a portion thereof extending outside of the receiver and being sized, shaped and adapted to be grasped by a hand of a shooter using the firearm and means for protecting the shooter from powder gases that may be around the charging handle when the firearm is fired.

BRIEF DESCRIPTION OF THE DRAWINGS

The invention will be hereinafter more fully described with reference to the accompanying drawings in which.

DETAILED DESCRIPTION OF THE PREFERRED EMBODIMENT

Figure 1:
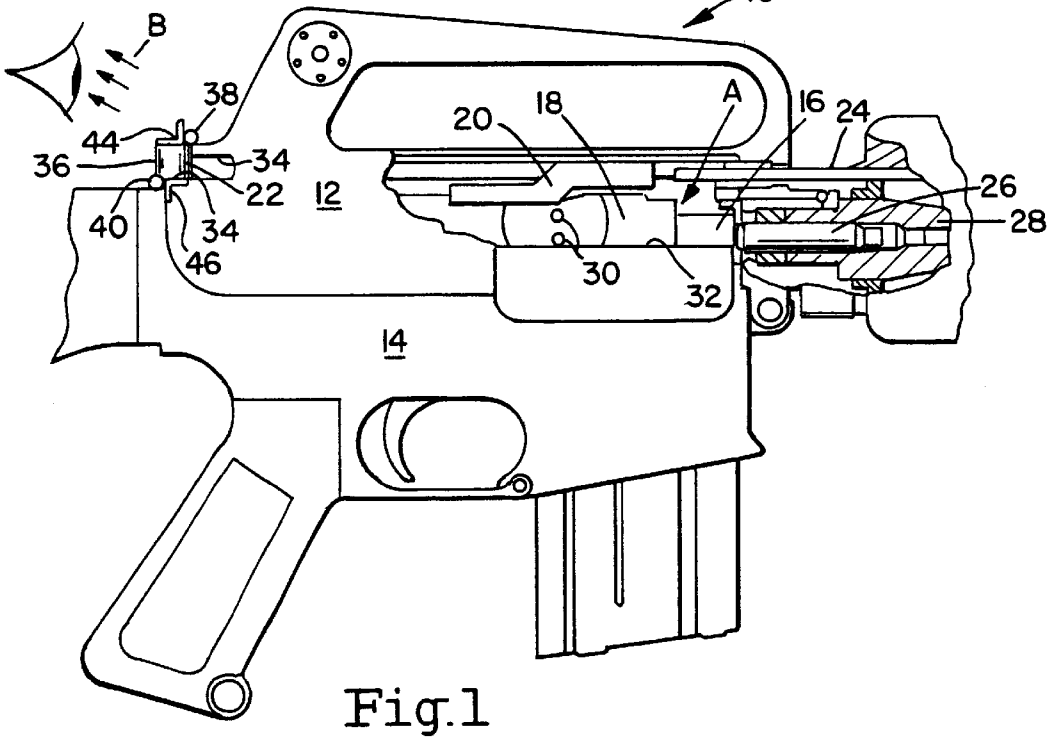
Fig.1 PRIOR ART
FIG. 1 is a side elevational view of a prior art firearm with a prior art charging handle illustrating the gas problem with a prior art charging handle and previous attempts to alleviate this problem.

FIG. 1 illustrates a side elevational view of the receiver area of an M-16 type firearm that is designated generally by the number 10 with portions broken away. The firearm 10 has the well known upper and lower receiver 12 and 14, bolt 16, bolt carrier 18 with its bolt carrier key 20, charging handle 22 and a gas tube 24. The firearm 10 illustrated in FIG. 1 is shown after a cartridge 26 has been fired and its bullet has just left the barrel 28. At this time, part of the powder gases generated from the fired cartridge 26 have passed through the gas tube 24 and into the bolt carrier key 20 with the resulting rearward movement of the bolt carrier 18 and bolt carrier key 20.

The bulk of the released powder gases are expelled out of the bolt carrier 18, through the ports 30 and out of the ejection port 32 of the firearm 10. However, powder gases are also released in the area designated by the letter A that is inside the receiver 12 of the firearm 10. These powder gases remain in the receiver 12 and this creates a positive gas pressure area. This positive gas pressure area and the rearward movement of the bolt 16 and the bolt carrier 18 when the firearm 10 is fired forces powder gases along with dirt and other debris inside the receiver 12 to the rear of the receiver 12 and out of the cracks 34 between the charging handle 22 and the upper receiver 12 and into the face and eyes of the person firing the firearm 10 as illustrated by the letter B.

Such gases, dirt and other debris not only interfere with the accurate shooting of the firearm 10, but also can be dangerous to the shooter and particularly the eyes of the shooter. It should be understood that any reference to powder gas or gases in connection with a charging handle is meant to include not only gases resulting from the combustion of the powder or propellant from cartridges but also may include oil, partially burnt powder, unburnt powder, mud, dust, and other similar matter collected in the firearm 10 in a hostile environment that can be contained in or carried by powder gases.

This undesirable problem of having powder gases introduced into the face of the shooter has been recognized in the past and attempts have been made to glue or bond silicone rubber to the charging handle 22 near its rear end portion 36 as illustrated by the numbers 38 and 40 in FIG. 1. Unfortunately, these rubber seals 38 and 40 tend not to be effective since they are readily eroded away by the heat and force of the powder gases. Another attempt to alleviate this powder gas problem has been through the addition of metal shields such as the shields 44 and 46 attached to the rear end portion 36 of the charging handle 22 as illustrated in FIG. 1. These shields 44 and 46 are attached to the charging handle 22 by screws (not shown). Unfortunately, these shields are not that effective and they tend to come loose in use. In addition, these shields 44 and 46 tend to interfere with the normal use of the charging handle 22. Fortunately, this invention does not have these problems associated with the silicone rubber seals 38 and 40 or the add on shields 44 and 46.

Figure 2:
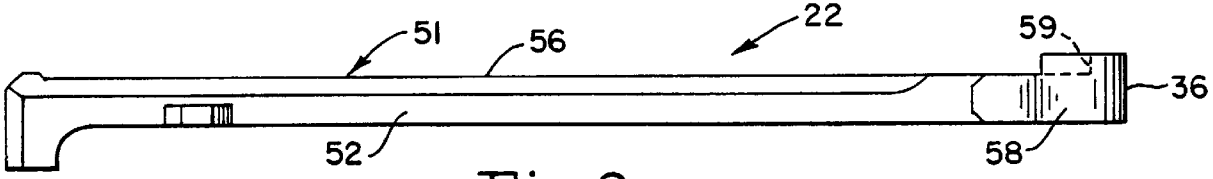
Fig.2 PRIOR ART
FIG. 2 is a side elevational view of a prior art charging handle such as set forth in FIG. 1.
Figure 3:
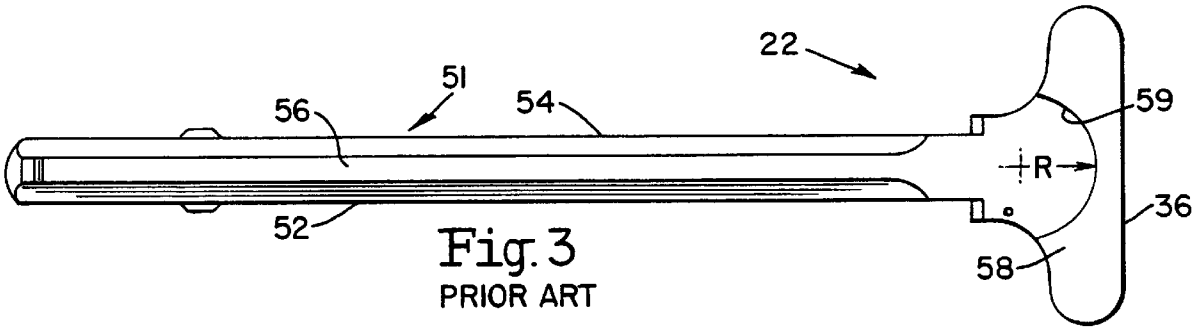
Fig. 3 PRIOR ART
FIG. 3 is a top plan view of the prior art charging handle illustrated in FIG. 2.

FIGS. 2 and 3 set forth the side and top views of the prior art charging handle designated generally by the number 22 for the M-16 type firearm 10 illustrated in FIG. 1. As illustrated in FIGS. 2 and 3, the charging handle 22 has an elongated body portion 51 with basically smooth and unbroken sides 52 and 54 and basically a smooth and unbroken top surface 56 that terminate in an enlarged handle portion 58 on the rear end portion 36 of the charging handle 22. Since both of the sides 52 and 54 and the top surface 56 of the charging handle 22 are smooth and unbroken they serve as excellent surfaces for powder gases to travel along and in addition there is really nothing on the handle portion 58 to deflect powder gases to any large extent. It should be noted that the charging handle 22 has a deflecting surface 59 that is shaped like a portion of the circumference of a circle that is located in the upper surface 56 of the handle portion 58. This deflecting surface 59 that is shaped to conform to the circumference of a circle in the prior art charging handle 22 for the M-16 family of weapons is part of the circumference of a circle with a radius R that is equal to 0.875 of an inch.

Figure 4:
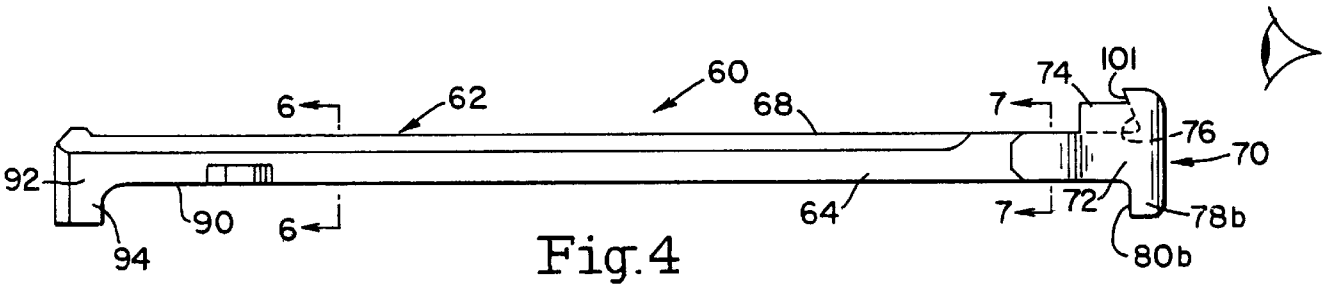
FIG. 4 is a side elevational view of the charging handle of the invention illustrating how powder gases are blocked to protect the eyes of the shooter.
Figure 5:
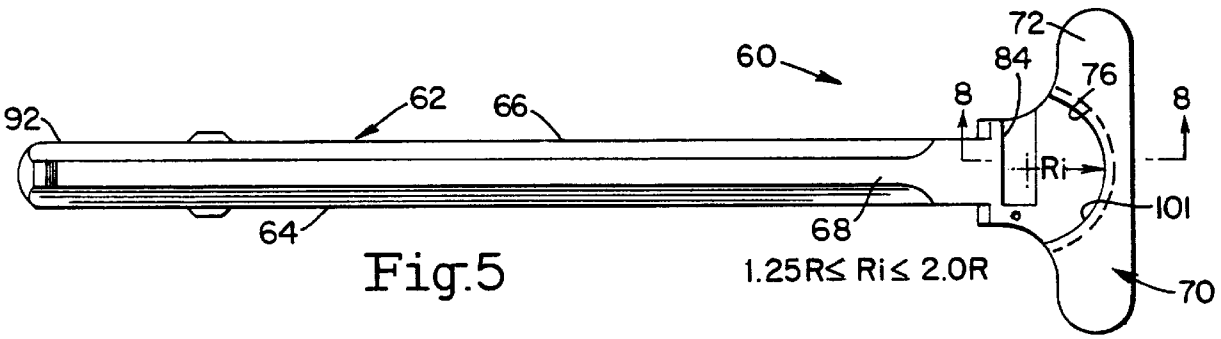
FIG. 5 is a top plan view of the charging handle of the invention set forth in FIG. 4 illustrating how powder gases are diverted to protect the eyes of the shooter.

FIGS. 4 and 5 set forth side and top views of the charging handle of the invention that is designated generally by the number 60. This charging handle 60 has an elongated body portion 62 that is identical to the body portion 51 for the prior art charging handle 22. This body portion has smooth and unbroken sides 64 and 66 and a smooth and unbroken top surface 68 that are the same as the corresponding surfaces 52, 54, and 56 of the body portion 51.

However, the charging handle invention 60 set forth in FIGS. 4 and 5 has important differences from the prior art charging handle 22 set forth in FIGS. 1, 2, and 3. Specifically, the charging handle 60 has an enlarged and differently configured rear end portion 70. In this connection, the rear end portion 70 has a generally T-shaped grasping handle portion 72 with an upward extending shield portion 74 that has a forward sloping gas deflecting surface 76 and right and left downward extending shield portions

78*a* and 78*b* that have respective gas deflecting surfaces 80*a* and 80*b*. These downward extending shield portions 78*a* and 78*b* are mirror images of each other and are located on the handle portion 72 in position to be located on each side of the adjacent portion of the lower receiver 14 of the firearm 10 when the charging handle 60 is installed in the firearm 10 and is in its normal forward firing position. The downward extending shield portions 78*a* and 78*b* must also be sized, shaped and located on the handle portion 72 to clear the butt stock of the firearm 10 when the charging handle 60 is pulled rearward.

As indicated in FIG. 5, the charging handle 60 has a grasping portion 72 with a gas deflecting surface 76 that is different from the surface 59 set forth in FIG. 3. In this connection, when viewed from the top as illustrated in FIG. 5 the gas deflecting surface 76 is shaped to conform to the circumference of a circle having a radius Ri and as indicated this Ri is related to the previous prior art R set forth in FIG.3 by the relationship:

$$1.25R \leq Ri \leq 2.0R$$

Where:

R Is the radius of the circle formed by the deflecting surface 59 on the charging handle 22 for the AR-15 or M-16 type family of firearms.

This relationship has been determined to be important for the proper deflection of powder gases etc. In the preferred embodiment, Ri is equal to 2.0R or 1.75 inches.

Figure 6:
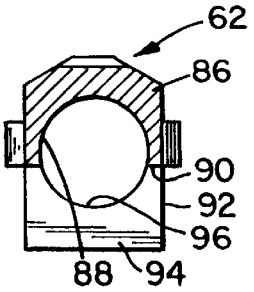
FIG. 6 is an enlarged sectional view of the charging handle of the invention set forth in FIG. 4 taken on the line 6—6 thereof.
Figure 7:
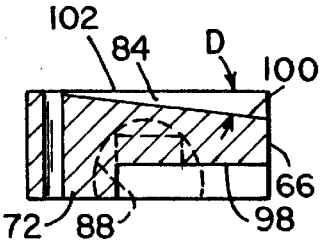
FIG. 7 is an enlarged sectional view of the charging handle of the invention set forth in FIG. 4 taken on the line 7—7 thereof.
Figure 8:
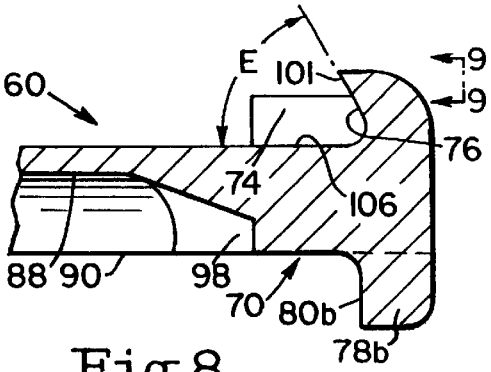
FIG. 8 is an enlarged sectional view of the charging handle of the invention set forth in FIG. 5 taken on the line 8—8 thereof.

Also as indicated in FIG. 5, the charging handle 60 has a rectangular shaped gas groove 84 in its upper surface 68 located adjacent to the grasping portion 72. FIGS. 6, 7, and 8 are sectional views taken on the lines 6—6, 7—7, and 8—8 on the views in FIGS. 4 and 5 that illustrate in greater detail the important features of the charging handle invention 60. As indicated by the sectional view in FIG. 6, the body portion 62 has a generally horseshoe shaped cross section 86 with an open channel 88 in the center of its underside 90. This same cross section is essentially unchanged for the entire length of the body portion 62. As also illustrated in FIG. 6, the forward portion 92 of the charging handle 60 has a downward depending portion 94 and a round aperture 96. This body portion 62 is identical to that of the standard prior art body portion 51 of the standard charging handle 22.

Figure 10:
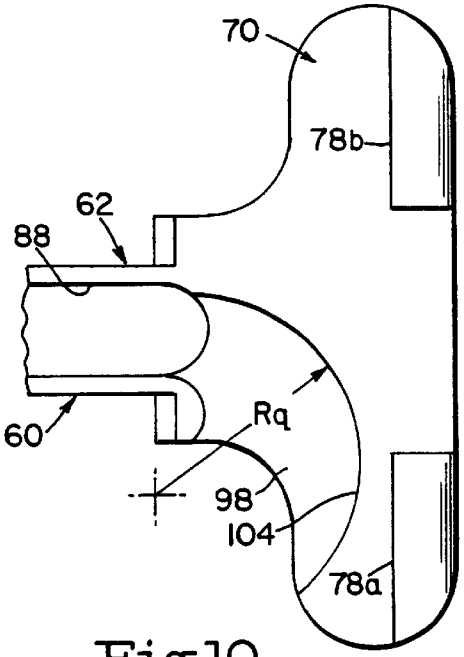
FIG. 10 is an enlarged bottom view of a portion of the charging handle of the invention set forth in FIG. 5.
Figure 9:
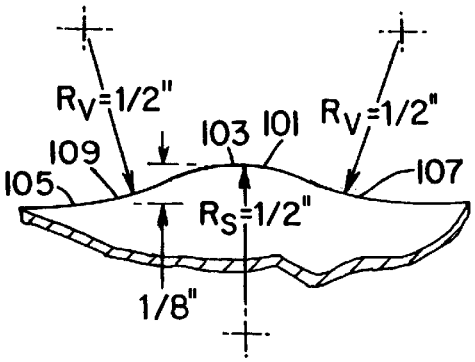
FIG. 9 is an enlarged end view of the charging handle of the invention set forth in FIG. 8 taken in the direction of the line 9—9 thereof.

The sectional views in FIGS. 7, 8 and 9 along with the bottom view in FIG. 10 of the rear end portion 70 of the charging handle 60 illustrate important features of the charging handle invention 60 that are different from the conventional charging handle 22. As illustrated in FIG. 10, the rear end portion 70 of the charging handle 60 has, in addition to the upper gas groove 84, a lower gas groove 98 that is in fluid communication with the open channel 88 in the underside of the body portion 62 so that any gas in this open channel 88 can readily pass into the lower gas groove 98 and leave the charging handle 60 and the firearm 10.

As previously indicated in FIG. 5, the upper gas groove 84 is rectangular shaped. Also, as illustrated in FIG. 7, the bottom surface 100 of this gas groove 84 makes an angle D with the upper surface 102 of the T-shaped grasping portion 72. In the preferred embodiment, this angle D is between five degrees and 10 degrees. In addition, this bottom surface 100 of the groove 84 slopes downward toward the right side 66 of the charging handle 60. Consequently, this groove 84 allows any gases that may move rearward along or adjacent the upper surface 102 of the charging handle 62 to pass into the groove 84 and be diverted by the groove 84 to the right side 66 of the charging handle 62 and away from the firearm 10.

In addition to the gas grooves 84 and 98 that direct powder gases to the right side of and away from the firearm 10, the charging handle 60 also has the rear portion 70 with the generally T-shaped grasping portion 72 with the upward extending shield portion 74 with the gas deflecting surface 76 and the downward shield portion 78*b* with its gas deflecting surface 80*b* that are also set forth in FIG. 8 as well as the previously described FIGS. 4 and 5. These deflecting surfaces 76 and 80*b* and also 80*a* cooperate with the grooves 84 and 98 to deflect additional gun gases that are not diverted by the grooves 84 and 98 in order to keep powder gases away from the vicinity of the eyes of the shooter.

As illustrated in FIG. 10, the wall 104 of the gas groove 98 is shaped to form part of the circumference of a circle with a radius Rq that should be between 0.6 of an inch and 1.0 inch and 0.65 of an inch in the preferred embodiment. Since the wall 104 is formed in the shape of part of the circumference of a circle, it tends to divert gun gases in the lower gas groove 98 not only outward but also forward toward the muzzle or front end portion of the firearm 10.

As best illustrated in FIGS. 8 and 9 and also FIG. 5, the rear end portion 70 of the charging handle 60 has an upward projecting gas deflecting protrusion 101 that is located in the center of the of the rear end portion 70 adjacent to the shield portion 74. As illustrated in FIG. 9, the protrusion 101, when viewed from the grasping handle portion 72 end of the charging handle 60, has the shape of a portion of the circumference of a circle with a radius Rs equal to substantially one half of an inch and its upper surface 103 is located substantially a distance equal to one half of an inch above the the adjacent upper surface 105 of the rear end portion 70. This protrusion 101 has curved surfaces 107 and 109 with radii Rv substantially equal to one half of an inch that merge with the upper surface 105. This protrusion 101 has a forward inclined gas deflecting surface 111 that is located adjacent to the previously described gas deflecting surface 76. As best illustrated in FIG. 8, the gas deflecting surface is also inclined at the same angle E as the gas deflecting surface 76 which is between 70 degrees and 80 degrees and 80 degrees in the preferred embodiment.

Figure 11:
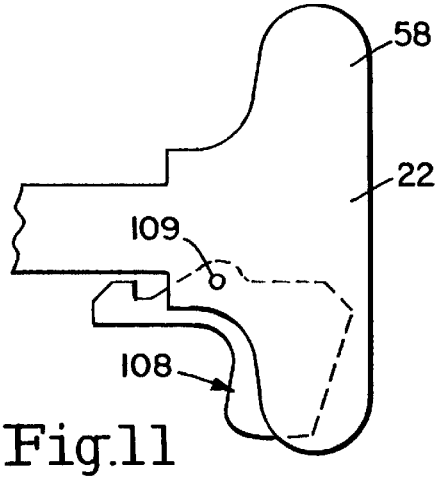
Fig.11 PRIOR ART
FIG. 11 is a top plan view of a prior art latch and associated handle portion for a charging handle.
Figure 12:
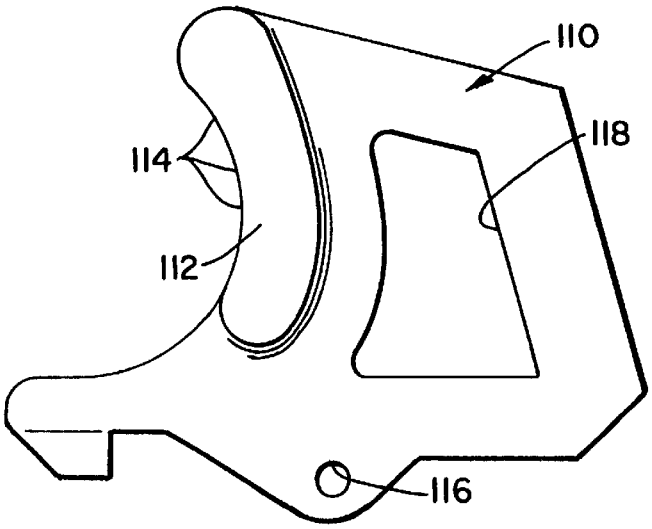
FIG. 12 is a top plan view of an improved latch for a charging handle that replaces the latch set forth in FIG. 11.
Figure 13:
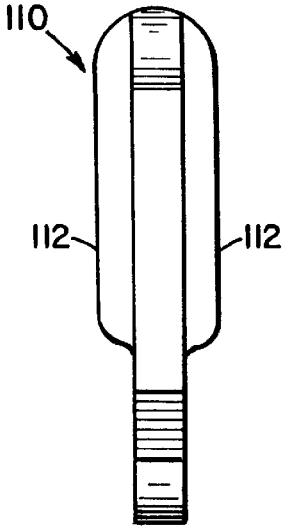
FIG. 13 is a rear elevational view of the latch illustrated in FIG. 12.

FIG. 11 illustrates a top view of a conventional charging handle latch that is designated generally by the number 108. This latch 108 is illustrated as it is attached by a pin 109 to the handle portion 58 of the conventional charging handle 22. This latch 108 locks the charging handle 22 in place in its forward position within the receiver of the firearm 10. The current prior art latch 108 is difficult to use and FIG. 12 illustrates the top view of an improved latch designated generally by the number 110 that overcomes the deficiencies of the previous latch 108. This new latch 110 has an important feature that is not present on the previous latch 108. This feature is the addition of an enlarged finger pad area 112 illustrated in FIGS. 12 and 13 that provides an enlarged surface area 114 that is to be contacted by the finger of the person that is using the firearm 10.

This enlarged surface area 114 allows the user of the firearm to easily exert a larger force to operate the latch 110 than is possible with a conventional prior art latch 108 that does not have this pad portion with its enlarged surface area 114. The latch with its enlarged surface area 114 is also easier to operate with a hand that has a glove on it. This enlarged surface area 114 is also illustrated in the end view set forth in FIG. 12. This new latch 110 has a conventional hole 116 that is located and sized to receive a conventional roll pin. In order to reduce the weight of the latch 110 a generally rectangular hole 118 is located in its central portion.

The charging handle 60 is made in the following manner. The charging handle 60 can be made in the same manner as the current charging handle 22 from suitable strength aluminum that can be forged or investment cast. Basically, the configuration is identical to the prior art charging handle 22 except that the rear portion 70 is larger and has a different shape as previous indicated. Any necessary forming or shaping is accomplished using conventional cutting, machining and shaping techniques that are well known in the art. The latch 110 is formed in a similar manner, however, in the preferred embodiment it is made by stamping from a suitable grade steel known in the art. The parts are protected by conventional anodizing for aluminum and by Parkerizing or a manganese phosphate coating in the case of the steel latch 110. The latch 110 is assembled on the charging handle 60 in a conventional manner using the conventional roll pin 118 and a conventional latch spring (not shown).

In order to install the charging handle 60, the prior art charging handle 22 is removed from the firearm 10 in a conventional manner, by pushing the firearm's take down pin to the left, opening the firearm 10 and removing the bolt carrier and bolt first and then the charging handle 22 from the firearm 10. The new charging handle 60 is then inserted into the firearm 10 in place of the prior art charging handle 22 and the firearm 10 is reassembled.

The new improved charging handle 60 is used in exactly the same manner as the prior art charging handle 22 except that it is easier to grasp and use by the shooter. In addition, the new charging handle 60 prevents or greatly reduces powder gases that are directed toward the eyes and face of the shooter.

Although the invention has been described in considerable detail with reference to a certain preferred embodiment, it will be understood that variations or modifications may be made within the spirit and scope of the invention as defined in the appended claims.

What is claimed is:

1. A charging handle for a firearm having a receiver, a bolt reciprocating within the receiver and a gas tube for directing powder gases to cause operation of the bolt within the receiver, said charging handle comprising a generally elongated member having an upper surface and an underside with a lower surface and a forward end portion, a body portion and a rearward end portion, said body portion having an open channel located in said underside thereof and said rearward end portion having at least a portion thereof adapted to extend outside of said receiver and being sized, shaped and adapted to be grasped by a hand of a shooter using said firearm wherein the improvement comprises: a gas groove located in said upper surface of said rearward end portion of said charging handle for diverting powder gases traveling along said upper surface of said charging handle away from said firearm; and a gas groove located in said lower surface of said rearward end portion of said charging handle located to be in fluid communication with said open channel located in said underside of said body portion of said charging handle for diverting powder gases from said open channel away from said firearm.

2. The charging handle for a firearm of claim 1 wherein said gas groove located in said upper surface of said rearward end portion of said charging handle has a bottom surface and said bottom surface makes an angle with said upper surface of said rearward end portion of said charging handle.

3. The charging handle for a firearm of claim 2 wherein said bottom surface of said gas groove located in said upper surface of said rearward end portion of said charging makes an angle of between five degrees and ten degrees with said upper surface of said rearward end portion of said charging handle.

4. The charging handle for a firearm of claim 2 wherein said charging handle has a right side and said bottom surface of said gas groove located in said upper surface of said rearward end portion of said charging handle slopes to said right side of said charging handle.

5. The charging handle for a firearm of claim 1 wherein said gas groove located in said upper surface of said rearward end portion of said charging handle is rectangular shaped.

6. The charging handle for a firearm of claim 1 wherein said gas groove located in said lower surface of said rearward end portion of said charging handle has a curved wall.

7. The charging handle for a firearm of claim 6 wherein said curved wall of said gas groove located in said lower surface of said rearward end portion of said charging handle is formed in the shape of part of the circumference of a circle.

8. The charging handle for a firearm of claim 7 wherein said curved wall is formed in the shape of part of the circumference of a circle with a radius between 0.6 of an inch and 1.0 inch.

9. The charging handle for a firearm of claim 7 wherein said curved wall is formed in the shape of part of the circumference of a circle with a radius of 0.65 of an inch.

10. The charging handle for a firearm of claim 1 wherein said rear end portion of said charging handle has an upward extending shield portion with a forward sloping gas deflecting surface.

11. The charging handle for a firearm of claim 1 wherein said rear end portion of said charging handle has two downward extending shield portions with gas deflecting surfaces.

* * * * *